US005710119A

United States Patent [19]

Busch et al.

[11] Patent Number: 5,710,119

[45] Date of Patent: Jan. 20, 1998

[54] DETERGENT COMPOSITIONS INHIBITING DYE TRANSFER COMPRISING COPOLYMERS OF N-VINYLIMIDAZOLE AND N-VINYLPYRROLIDONE

[75] Inventors: Alfred Busch, Londerzeel; Andre Christian Convents, Diegem, both of Belgium

[73] Assignee: The Procter & Gamble Company, Cincinnati, Ohio

[21] Appl. No.: 583,109

[22] PCT Filed: Jun. 20, 1994

[86] PCT No.: PCT/US94/06951

§ 371 Date: Jan. 16, 1996

§ 102(e) Date: Jan. 16, 1996

[87] PCT Pub. No.: WO95/03382

PCT Pub. Date: Feb. 2, 1995

[30] Foreign Application Priority Data

Jul. 23, 1993 [EP] European Pat. Off. ..... 93870155

[51] Int. Cl.[6] ..... C11D 3/37

[52] U.S. Cl. ..... 510/360; 510/320; 510/321; 510/340; 510/341; 510/350; 510/351; 510/352; 510/356; 510/357; 510/445; 510/475; 510/507

[58] Field of Search ..... 510/475, 500, 510/360, 320, 322, 334, 321, 327, 328, 392, 393, 507, 340, 341, 350, 351, 352, 356, 357, 445; 393/507

[56] References Cited

U.S. PATENT DOCUMENTS

| | | | |
|---|---|---|---|
| 5,443,750 | 8/1995 | Convents et al. | 510/322 |
| 5,451,341 | 9/1995 | White | 510/299 |
| 5,466,802 | 11/1995 | Panandiker et al. | 510/320 |
| 5,500,154 | 3/1996 | Bacon et al. | 510/102 |

FOREIGN PATENT DOCUMENTS

| | | |
|---|---|---|
| 0 327 927 A2 | 8/1989 | European Pat. Off. . |
| 0 372 291 A1 | 6/1990 | European Pat. Off. . |
| 0 538 228 | 4/1993 | European Pat. Off. . |
| 28 14 287 | 10/1979 | Germany . |
| 40 27 832 A1 | 3/1992 | Germany . |

OTHER PUBLICATIONS

English translation of DE 28 14 287 (Waldhoff et al.), Oct. 1979.

English translation of EP 0 327 927, Aug. 1989.

English translation of EP 0 372 291, Jun. 1990.

English translation of DE 40 27 832, Mar. 1992.

*Primary Examiner*—Ardith Hertzog

*Attorney, Agent, or Firm*—K. K. Patel; K. W. Zerby; J. C. Rasser

[57] ABSTRACT

A detergent composition comprising a surfactant system substantially free of linear alkyl benzene sulfonate and a copolymer of N-vinylimidazole and N-vinylpyrrolidone. The copolymer is present in the detergent composition in an amount of 0.01% to 10.0% by weight and has an average molecular weight of from 5,000 to 1,000,000. The molar ratio of N-vinylimidazole to N-vinylpyrrilidone in the copolymer is from 1:1 to 1:0.2.

18 Claims, No Drawings

DETERGENT COMPOSITIONS INHIBITING DYE TRANSFER COMPRISING COPOLYMERS OF N-VINYLIMIDAZOLE AND N-VINYLPYRROLIDONE

FIELD OF THE INVENTION

The present invention relates to a composition and a process for inhibiting dye transfer between fabrics during washing. More in particular, the present invention relates to detergent compositions comprising N-vinylimidazole N-vinylpyrrolidone copolymers.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to complex or adsorb the fugitive dyes washed out of dyed fabrics before they have the opportunity to become attached to other articles in the wash.

Polymers have been used within detergent compositions to inhibit dye transfer. One type of such polymers are N-vinylimidazole homo-and copolymers. Examples of said polymers are described in prior art documents such as DE 2 814 287-A which relates to detergent compositions comprising 0.1 to 10 wt % water-soluble or water-dispersible N-vinyl imidazole homo- or copolymer in combination with anionic and/or nonionic surfactants and other detergent ingredients. EP 372 291 relates to a process for washing discolouration-sensitive textiles. The wash liquor contains anionic/nonionic surfactants and watersoluble polymers e.g. (co)polymers N-vinylimidazole, N-vinyloxazolidone or N-vinylpyrrolidone. EP 327 927 describes a granular detergent additive comprising water-soluble polymeric compounds based on N-vinylpyrrolidone and/or N-vinylimidazole and/or N-vinyloxazolidone and cationic compounds. DE 4027832-A discloses electrolyte-free liquid detergent compositions comprising zeolite A, nonionic surfactants and dye transfer inhibiting polymers. The dye transfer inhibiting polymers are homo-and copolymers selected from N-vinylpyrrolidone and/or N-vinylimidazole and/or N-vinyloxazolidone.

It has now been found that the N-vinylimidazole N-vinylpyrrolidone copolymers are very efficient in eliminating transfer of solubilized or suspended dyes while enhancing the detergency performance of specific detergent ingredients formulated therewith.

This finding allows to formulate detergent compositions which exhibit excellent cleaning and dye transfer inhibiting properties.

According to another embodiment of this invention a process is also provided for laundering operations involving colored fabrics.

SUMMARY OF THE INVENTION

The present invention relates to detergent compositions comprising a polymer selected from N-vinylimidazole N-vinylpyrrolidone copolymers in combination with specific detergent ingredients.

DETAILED DESCRIPTION OF THE INVENTION

The N-vinylimidazole N-vinylpyrrolidone copolymer

The present invention comprises as an essential detergent ingredient a polymer selected from the N-vinylimidazole N-vinylpyrrolidone copolymers.

Said N-vinylimidazole N-vinylpyrrolidone have found to enhance the detergency performance of certain detergent ingredients formulated therewith.

The N-vinylimidazole N-vinylpyrrolidone polymers have an average molecular weight range from 5000–1,000,000, preferably from 20 000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000

The average molecular weight range was determined by light scattering as described in Barth H. G. and Mays J. W. Chemical Analysis Vol. 113. "Modern Methods of Polymer Characterization. In addition, it has been found that an excellent overall detergency performance of detergent compositions comprising N-vinylimidazole N-vinylpyrrolidone copolymers can be obtained by selecting a specific average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

The N-vinylimidazole N-vinylpyrrolidone copolymers can be lineair or branched. The level of the N-vinylimidazole N-vinylpyrrolidone present in the detergent compositions is from 0.01 to 10%, more preferably from 0.05 to 5%, most preferably from 0.1 to 1% by weight of the detergent composition.

DETERGENT INGREDIENTS

The detergent compositions according to the present invention comprise in addition to the N-vinylimidazole N-vinylpyrrolidone copolymers certain specific detergent ingredients.

It has been found that the combination of N-vinylimidazole N-vinylpyrrolidone copolymers with said detergent ingredients enhances the dye transfer inhibiting properties of the N-vinylimidazole N-vinylpyrrolidone copolymers.

A first class of ingredients are surfactant systems wherein the surfactant is a non-alkylbenzene sulfonate salt containing surfactant system wherein the surfactant can be selected from nonionic and/or anionic and/or cationic and/or ampholytic and/or zwitterionic and/or semi-polar surfactants.

Preferred non-alkylbenzene sulfonate salt containing surfactant systems to be used according to the present invention comprise as a surfactant one or more of the nonionic and/or anionic surfactants described herein. These surfactants have found to be very useful in that the dye transfer inhibiting performance of the N-vinylimidazole N-vinylpyrrolidone copolymers has been increased in the presence of said surfactants.

Polyethylene, polypropylene, and polybutylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide) marketed by Shell Chemical Company, and Kyro™ EOB (the condensation product of $C_{13}$–$C_{15}$ alcohol with 9 moles ethylene oxide), marketed by The Procter & Gamble Company.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units.

The preferred alkylpolyglycosides have the formula $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7.

The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Other suitable nonionic surfactants are the condensation products of ethylene oxide with a hydrophobic base formed by the condensation of propylene oxide with propylene glycol are also suitable for use as the additional nonionic surfactant of the nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydoxy fatty acid amide surfactants of the formula.

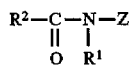

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

When included in such laundry detergent compositions, the nonionic surfactant systems of the present invention act to improve the greasy/oily stain removal properties of such laundry detergent compositions across a broad range of laundry conditions.

Highly preferred anionic surfactants include alkyl alkoxylated sulfate surfactants which can be water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

Suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

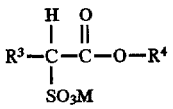

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which can be water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

The alkyl alkoxylated sulfate surfactants have found to provide superior dye transfer inhibition versus the alkyl benzene sulfonates surfactants in that said alkyl alkoxylated sulfate surfactants improve the dye transfer inhibiting performance of the N-vinyl imidazole N-vinylpyrrolidone copolymers.

The laundry detergent compositions of the present invention may also contain cationic, ampholytic, zwitterionic, and semi-polar surfactants, as well as the nonionic and/or anionic surfactants other than those already described herein. Preferred cationic surfactant systems include nonionic and ampholytic surfactants.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and $—(C_2H_{40})_xH$ where x has a value from 2 to 5, and X is an anion. Not more than one of $R_2$, $R_3$ or $R_4$ should be benzyl. The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is $—CH_2—O—C—C_{12-14}$ alkyl and $R_2R_3R_4$ are methyl).

O di-alkyl imidazolines [compounds of formula (i)].

Other cationic surfactants useful herein are also described in U.S. Pat. No. 4,228,044, Cambre, issued Oct. 14, 1980.

When included therein, the laundry detergent compositions of the present invention typically comprise from 0% to about 25%, preferably from about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the laundry detergent compositions of the present invention typically comprise from 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the laundry detergent compositions of the present invention typically comprise from 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

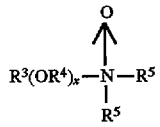

wherein $R^3$ is an alkyl, hydroxyalkyl, or alkyl phenyl group or mixtures therof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the laundry detergent compositions of the present invention typically comprise from 0% to about 15%, preferably from about 1% to about 10% by weight of such semi-polar nonionic surfactants.

The present invention further provides laundry detergent compositions comprising at least 1% by weight, preferably from about 3% to about 65%, more preferably from about 10% to about 25% by weight of total surfactants.

A second class of detergent ingredients that has found to provide enhanced dye transfer inhibiting benefits are enzymes selected from peroxidases, cellulases or mixtures thereof.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Other suitable cellulases are cellulases originated from Humicola Insulens having a molecular weight of about 50 KDa, an isoelectric point of 5.5 and containing 415 amino acids. Such cellulase are described in Copending European patent application Ser. No. 93200811.3, filed Mar. 19, 1993. Especially suitable cellulase are the cellulase having color care benefits. Examples of such cellulases are cellulase described in European patent application Ser. No. 91202879.2, filed Nov. 6, 1991 Carezyme (Novo). It has been found that the N-vinylimidazole N-vinylpyrrolidone copolymers synergistically improve the performance in of the cellulases in terms of colour appearance.

Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunoligical cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Especially suitable Lipase are lipase such as M1 Lipase (Ibis) and Lipolase (Novo).

Peroxidase enzymes are used in combination with oxygen sources, e.g. percarbonate, perborate, persulfate, hydrogen peroxide, etc. They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

It has been found that the N-vinyl imidazole N-vinylpyrrolidone copolymers synergistically improve the dye transfer inhibiting performance of the peroxidase.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B.subtilis* and *B.licheniforms*. Proteolytic enzymes suitable for removing protein-based stains that are commercially available include those sold under the tradenames Alcalase, Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A is described in European Patent Application 130,756. Protease B is described in European Patent Application Serial No. 87303761.8. Amylases include, for example, amylases obtained from a special strain of *B.licheniforms*, described in more detail in British Patent Specification No. 1,296,839 (Novo). Amylolytic proteins include, for example, Rapidase, Maxamyl (International Bio-Synthetics, Inc.) and Termamyl,(Novo Industries).

In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. No. 4,261,868, U.S. Pat. No. 3,600,319, and European Patent Application Publication No. 0 199 405, Application No. 86200586.5. Non-boric acid and borate stabilizers are preferred. Enzyme stabilization systems are also described, for example, in U.S. Pat. Nos. 4,261,868, 3,600,319 and 3,519,570.

Other suitable detergent ingredients that can be added are enzyme oxidation scavengers which are described in Copending European Patent application N 92870018.6 filed on Jan. 31, 1992. Examples of such enzyme oxidation scavengers are ethoxylated tetraethylene polyamines.

Especially preferred detergent ingredients are combinations with technologies which also provide a type of color care benefit. Examples of these technologies are polyvinylpyrrolidone polymers such as described in EP 0 508 034 and polyamine-N-oxide containing polymers such as described in Copending European patent application N 92202168.8 and N 93201198.4. Other examples are cellulase and/or peroxidases and/or metallo catalysts for color maintance rejuvenation. Such metallo catalysts are described in copending European Patent Application No. 92870181.2. In addition, it has been found that the N-imidazole N-vinylpyrrolidone copolymers according to the present invention eliminate or reduce the deposition of the metallo-catalyst onto the fabrics resulting in improved whiteness benefit.

Preferred detergent ingredients that can be included in the detergent compositions of the present invention include bleaching agents. These bleaching agent components can include one or more oxygen bleaching agents and, depending upon the bleaching agent chosen, one or more bleach activators. When present bleaching compounds will typically be present at levels of from about 1% to about 10%, of the detergent composition. In general, bleaching compounds are optional components in non-liquid formulations, e.g. granular detergents. If present, the amount of bleach activators will typically be from about 0.1% to about 60%, more typically from about 0.5% to about 40% of the bleaching composition.

The bleaching agent component for use herein can be any of the bleaching agents useful for detergent compositions including oxygen bleaches as well as others known in the art.

In a method aspect, this invention further provides a method for cleaning fabrics, fibers, textiles, at temperatures below about 50° C., especially below about 40° C., with a detergent composition containing N-vinylimidazole N-vinylpyrrolidone copolymers in combination with bleaching agents. The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzene-sulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters such as disclosed in Copending European Patent Application No. 91870207.7.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Preferably, the compositions according to the present invention comprise a clay. It has been found that the N-vinylimidazole N-vinylpyrrolidone copolymers according to the present invention are very compatible with the clays in that the dye transfer inhibiting properties of the polymers are not adversely affected by the presence of clays formulated therewith. In addition, it has been found that the softening performance of clays formulated with the N-vinylimidazole N-vinylpyrrolidone copolymers has been maintained. Especially suitable are clays such as fabric softening clays which are described in EP 0 522 206.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydro-furan-cis, cis, cis-tetracarboxylates, 2,5-tetrahydro-furan-cis-dicarboxylates, 2,2,5,5-tetrahydrofuran-tetracarboxylates, 1,2,3,4,5,6-hexane -hexacarboxylates and and carboxymethyl derivatives of polyhydric alcohols such as sorbitol, mannitol and xylitol. Aromatic poly-carboxylates include mellitic acid, pyromellitic acid and the phtalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (sks/6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R.

Such suds suppressor system are described in Copending European Patent application N 92870174.7 filed 10 Nov., 1992.

Especially preferred silicone suds controlling agents are described in Copending European Patent application No92201649.8.

Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Other components used in detergent compositions may be employed, such as soil-suspending agents soil-release agents, optical brighteners, abrasives, bactericides, tarnish inhibitors, coloring agents, and/or encapsulated or non-encapsulated perfumes.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4-anilino-s-triazin-6-ylamino)stilbene- 2:2$^1$ disulphonate, disodium 4,-4$^1$-bis-(2-morpholino-4-anilino-s-triazin-6-ylaminostilbene-2:2$^1$-disulphonate, disodium 4,4$^1$-bis-(2,4-dianilino-s-triazin-6-ylamino)stilbene-2:2$^1$-disulphonate, monosodium 4$^1$,4$^{11}$-bis-(2,4-dianilino-s-triazin-6ylamino)stilbene-2-sulphonate, disodium 4,4$^1$-bis-(2-anilino-4-(N-methyl-N-2-hydroxyethylamino)-s-triazin-6-ylamino)stilbene-2,2$^1$-disulphonate, disodium 4,4$^1$-bis-(4-phenyl-2,1,3-triazol-2-yl)-stilbene-2,2$^1$disulphonate, disodium 4,4$^1$bis(2-anilino-4-(1-methyl-2-hydroxyethylamino)-s-triazin-6-ylamino)stilbene-2, $2^1$disulphonate and sodium 2(stilbyl-$4^{11}$-(naphtho-$1^1$,$2^1$:4,5)-1,2,3-triazole-$2^{11}$-sulphonate.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}CH_3)_{0.75}$$

where PEG is —$(OC_2H_4)O$—, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1-2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1-2 diol, thereof consist "secondarily" of such species.

The selected polyesters herein contain about 46% by weight of dimethyl terephtalic acid, about 16% by weight of propane -1.2 diol, about 10% by weight ethylene glycol about 13% by weight of dimethyl sulfobenzoid acid and about 15% by weight of sulfoisophtalic acid, and have a molecular weight of about 3.000. The polyesters and their method of preparation are described in detail in EPA 311 342.

The detergent compositions according to the invention can be in liquid, paste, gels or granular forms. Especially preferred detergent compositions are detergent compositions having a pH between 7–11, more preferably a pH between 9–10.5.

Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions. Other examples of liquid compositions are anhydrous compositions containing substantially no water. Both aqueous and non-aqueous liquid compositions can be structured or non-structured.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. and higher temperatures. The pH of the treatment solution is preferably from 7 to 11, especially from 7.5 to 10.5.

The process and compositions of the invention can also be used as detergent additive products.

Such additive products are intended to supplement or boost the performance of conventional detergent compositions.

The detergent compositions according to the present invention include compositions which are to be used for cleaning substrates, such as fabrics, fibers, hard surfaces, skin etc., for example hard surface cleaning compositions (with or without abrasives), laundry detergent compositions, automatic and non automatic dishwashing compositions.

The following examples are meant to exemplify compositions of the present invention, but are not necessarily meant to limit or otherwise define the scope of the invention, said scope being determined according to claims which follow.

EXAMPLE I (A/B/C/D)

A liquid detergent composition according to the present invention is prepared, having the following compositions:

% by weight of the total detergent composition

| | A | B | C | D |
|---|---|---|---|---|
| Linear alkylbenzene sulfonate | 10 | — | — | — |
| Polyhydroxy fatty acid amide | — | 5 | — | 3 |
| Alkyl alkoxylated sulfate | — | — | 9 | 4 |
| Alkyl sulphate | 4 | 8 | 4 | 15 |
| Fatty alcohol ($C_{12}$–$C_{15}$) ethoxylate | 12 | 12 | 12 | 5 |
| Fatty acid | 10 | 10 | 10 | 10 |
| Oleic acid | 4 | 4 | 4 | — |
| Citric acid | 1 | 1 | 1 | 1 |
| Diethylenetriaminepenta methylene Phosphonic acid | 1.5 | 1.5 | 1.5 | 1.5 |
| NaOH | 3.4 | 3.4 | 3.4 | 3.4 |
| Propanediol | 1.5 | 1.5 | 1.5 | 1.5 |
| Ethanol | 10 | 10 | 10 | 10 |
| Ethoxylated tetraethylene pentamine | 0.7 | 0.7 | 0.7 | 0.7 |
| Thermamyl R 300 KNU/g | 0.1 | 0.1 | 0.1 | 0.1 |
| Carezyme R 5000 CEVU/g | 0.02 | 0.02 | 0.02 | 0.02 |
| Protease 40 mg/g | 1.8 | 1.8 | 1.8 | 1.8 |
| Lipolase R 100 KLU/g | 0.1 | 0.1 | 0.1 | 0.1 |
| Endoglucanase A 5000 CEVU/g | 0.5 | 0.5 | 0.5 | 0.5 |
| Suds supressor (ISOFOL®) | 2.5 | 2.5 | 2.5 | 2.5 |
| $H_2O_2$ | 7.5 | 7.5 | — | — |
| N-vinylimidazole N-vinyl pyrrolidone copolymer | 0.1–1 | 0.1–1 | 0.1–1 | 0.1–1 |
| Minors | | up to 100 | | |

EXAMPLE II (A/B/C/D)

A liquid detergent composition according to the present invention is prepared, having the following compositions:

| % by weight of the total detergent composition | A | B | C | D |
|---|---|---|---|---|
| Linear alkylbenzene sulfonate | 10 | — | — | — |
| Polyhydroxy fatty acid amide | — | 5 | — | 3 |
| Alkyl alkoxylated sulfate | — | — | 9 | 4 |
| Alkyl sulphate | 4 | 8 | 4 | 15 |
| Fatty alcohol ($C_{12}$–$C_{15}$) ethoxylate | 12 | 12 | 12 | 5 |
| Fatty acid | 10 | 10 | 10 | 10 |
| Oleic acid | 4 | 4 | 4 | — |
| Citric acid | 1 | 1 | 1 | 1 |
| Diethylenetriaminepenta methylene Phosphonic acid | 1.5 | 1.5 | 1.5 | 1.5 |
| NaOH | 3.4 | 3.4 | 3.4 | 3.4 |
| Propanediol | 1.5 | 1.5 | 1.5 | 1.5 |
| Ethanol | 10 | 10 | 10 | 10 |
| Ethoxylated tetraethylene pentamine | 0.7 | 0.7 | 0.7 | 0.7 |
| Thermamyl R 300 KNU/g | 0.1 | 0.1 | 0.1 | 0.1 |
| Carezyme R 5000 CEVU/g | 0.02 | 0.02 | 0.02 | 0.02 |
| Protease 40 mg/g | 1.8 | 1.8 | 1.8 | 1.8 |
| Lipolase R 100 KLU/g | 0.1 | 0.1 | 0.1 | 0.1 |
| Endoglucanase A 5000 CEVU/g | 0.5 | 0.5 | 0.5 | 0.5 |
| Suds supressor (ISOFOL®) | 2.5 | 2.5 | 2.5 | 2.5 |
| $H_2O_2$ | 7.5 | 7.5 | — | — |
| N-vinylimidazole N-vinyl-pyrrolidone copolymer | 0.1–1 | 0.1–1 | 0.1–1 | 0.1–1 |
| Metallo catalyst | 0.1–1 | 0.1–1 | 0.1–1 | 0.1–1 |
| Poly(4-vinylpyridine)-N-oxide | 0.1–1 | 0.1–1 | 0.1–1 | 0.1–1 |
| clay | — | — | 4 | 4 |
| peroxidase | 0.1 | 0.1 | — | — |
| Minors | | up to 100 | | |

EXAMPLE III (A/B/C/D/E)

A compact granular detergent composition according to the present invention is prepared, having the following formulation:

| % by weight of the total detergent composition | A | B | C | D | E |
|---|---|---|---|---|---|
| Linear alkyl benzene sulphonate | 11.40 | — | — | — | — |
| Polyhydroxy fatty acid amide | — | 10 | — | — | — |
| Alkyl alkoxylated sulfate | — | — | 9 | 9 | 9 |
| Tallow alkyl sulphate | 1.80 | 1.80 | 1.80 | 1.80 | 1.80 |
| $C_{45}$ alkyl sulphate | 3.00 | 3.00 | 3.00 | 3.00 | 3.00 |
| $C_{45}$ alcohol 7 times ethoxylate | 4.00 | 4.00 | 4.00 | 4.00 | 4.00 |
| Tallow alcohol 11 times ethoxylated | 1.80 | 1.80 | 1.80 | 1.80 | 1.80 |
| Dispersant | 0.07 | 0.07 | 0.07 | 0.07 | 0.07 |
| Silicone fluid | 0.80 | 0.80 | 0.80 | 0.80 | 0.80 |
| Trisodium citrate | 14.00 | 14.00 | 14.00 | 14.00 | 14.00 |
| Citric acid | 3.00 | 3.00 | 3.00 | 3.00 | 3.00 |
| Zeolite | 32.50 | 32.50 | 32.50 | 32.50 | 32.50 |
| Diethylenetriamine penta nethylene phosphonic acid | 0.6 | 0.6 | 0.6 | 0.6 | 0.6 |
| Maleic acid acrylic acid copolymer | 5.00 | 5.00 | 5.00 | 5.00 | 5.00 |
| Cellulase (active protein) | 0.03 | 0.03 | 0.03 | 0.03 | 0.03 |
| Alkalase/BAN | 0.60 | 0.60 | 0.60 | 0.60 | 0.60 |
| Lipolase | 0.36 | 0.36 | 0.36 | 0.36 | 0.36 |
| Sodium silicate | 2.00 | 2.00 | 2.00 | 2.00 | 2.00 |
| Sodium sulphate | 3.50 | 3.50 | 3.50 | 3.50 | 3.50 |
| Percarbonate | — | — | — | 20 | — |
| Perborate | 15 | 15 | 15 | — | — |
| TAED | 5 | — | 5 | 5 | — |

-continued

| % by weight of the total detergent composition | A | B | C | D | E |
|---|---|---|---|---|---|
| N-vinylimidazole N-vinyl-pyrrolidone copolymer | 0.1–1 | 0.1–1 | 0.1–1 | 0.1–1 | 0.1–1 |
| Minors | | | | up to 100 | |

EXAMPLE IV (A/B/C/D/E)

A compact granular detergent composition according to the present invention is prepared, having the following formulation:

| % by weight of the total detergent composition | A | B | C | D | E |
|---|---|---|---|---|---|
| Linear alkyl benzene sulphonate | 11.40 | — | — | — | — |
| Polyhydroxy fatty acid amide | — | 10 | — | — | |
| Alkyl alkoxylated sulfate | — | — | 9 | 9 | 9 |
| Tallow alkyl sulphate | 1.80 | 1.80 | 1.80 | 1.80 | 1.80 |
| $C_{45}$ alkyl sulphate | 3.00 | 3.00 | 3.00 | 3.00 | 3.00 |
| $C_{45}$ alcohol 7 times etoxylated | 4.00 | 4.00 | 4.00 | 4.00 | 4.00 |
| Tallow alcohol 11 times ethoxylated | 1.80 | 1.80 | 1.80 | 1.80 | 1.80 |
| Dispersant | 0.07 | 0.07 | 0.07 | 0.07 | 0.07 |
| Silicone fluid | 0.80 | 0.80 | 0.80 | 0.80 | 0.80 |
| Trisodium citrate | 14.00 | 14.00 | 14.00 | 14.00 | 14.00 |
| Citric acid | 3.00 | 3.00 | 3.00 | 3.00 | 3.00 |
| Zeolite | 32.50 | 32.50 | 32.50 | 32.50 | 32.50 |
| Diethylenetriamine penta-nethylene phosphonic acid | 0.6 | 0.6 | 0.6 | 0.6 | 0.6 |
| Maleic acid acrylic acid copolymer | 5.00 | 5.00 | 5.00 | 5.00 | 5.00 |
| Cellulase (active protein) | 0.03 | 0.03 | 0.03 | 0.03 | 0.03 |
| Savinase | 0.60 | 0.60 | 0.60 | 0.60 | 0.60 |
| Lipolase | 0.36 | 0.36 | 0.36 | 0.36 | 0.36 |
| Sodium silicate | 2.00 | 2.00 | 2.00 | 2.00 | 2.00 |
| Sodium sulphate | 3.50 | 3.50 | 3.50 | 3.50 | 3.50 |
| Percarbonate | — | — | — | 20 | — |
| Perborate | 15 | 15 | 15 | — | — |
| TAED | 5 | — | 5 | 5 | — |
| N-vinylimidazole N-vinyl-pyrrolidone copolymer | 0.1–1 | 0.1–1 | 0.1–1 | 0.1–1 | 0.1–1 |
| Metallo catalyst | 0.1–1 | 0.1–1 | 0.1–1 | 0.1–1 | 0.1–1 |
| Poly(4-vinylpyridine)-N-N-oxide | 0.1–1 | 0.1–1 | 0.1–1 | 0.1–1 | 0.1–1 |
| Clay | — | — | — | 4 | 4 |
| peroxidase | — | 0.1 | 0.1 | — | — |
| Minors | | | up to 100 | | |

The above compositions (Example I,II (A/B/C/D) and II,IV (A/B/C/D/E)) were very good at displaying excellent cleaning and detergency performance with outstanding color-care performance on colored fabrics and mixed loads of colored and white fabrics.

We claim:

1. A detergent composition comprising:

greater than 1% by weight of the detergent composition of a surfactant system essentially free of linear alkyl benzene sulfonate; and from 0.01% to 10% by weight of the detergent composition of a copolymer of N-vinylimidazole and N-vinylpyrrolidone, the copolymer having a molar ratio of N-vinylimidazole to N-vinylpyrrolidone in the range of from 1:1 to 1:0.2 and an average molecular weight in the range of from 5,000 to 1,000,000.

2. The detergent composition according to claim 1, wherein the copolymer has an average molecular weight of from 5,000 to 50,000.

3. The detergent composition according to claim 1, wherein the copolymer has an average molecular weight of from 8,000 to 30,000.

4. The detergent composition according to claim 1, wherein the copolymer has an average molecular weight of from 10,000 to 20,000.

5. The detergent composition according to claim 1, wherein the molar ratio of N-vinylimidazole to N-vinylpyrrolidone is in the range of from 1:0.8 to 1:0.3.

6. The detergent composition according to claim 1, wherein the molar ratio of N-vinylimidazole to N-vinylpyrrolidone is in the range of from 1:0.6 to 1:0.4.

7. The detergent composition according to claim 1, comprising from 0.05 to 5.0% by weight of the copolymer.

8. The detergent composition according to claim 1, comprising from 0.1 to 1.0% by weight of the copolymer.

9. A detergent composition according to claim 1, wherein the surfactant system comprises alkyl alkoxylated sulfate.

10. The detergent composition according to claim 1, wherein the detergent composition comprises 3 to 65% by weight of the surfactant system.

11. The detergent composition according to claim 1, wherein the detergent composition comprises 10 to 25% by weight of the surfactant system.

12. The detergent composition according to claim 1, wherein the surfactant system further comprises anionic surfactants in an amount of 1 to 40% by weight of the detergent composition.

13. The detergent composition according to claim 1, wherein the detergent composition has a pH between 7 and 11.

14. The detergent composition according to claim 1, wherein the detergent composition has a pH between 9 and 10.5.

15. The detergent composition according to claim 1, wherein the detergent composition is granular.

16. The detergent composition according to claim 1, further comprising an enzyme selected from the group consisting of cellulases, peroxidases and mixtures thereof.

17. The detergent composition according to claim 1, further comprising a clay.

18. The detergent composition according to claim 1, further comprising a metallo catalyst.

* * * * *